US008284899B2

(12) United States Patent
Virshup

(10) Patent No.: US 8,284,899 B2
(45) Date of Patent: Oct. 9, 2012

(54) X-RAY TUBE HAVING A FOCAL SPOT PROXIMATE THE TUBE END

(75) Inventor: Gary Fredric Virshup, Cupertino, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 11/944,188

(22) Filed: Nov. 21, 2007

(65) Prior Publication Data

US 2009/0129549 A1 May 21, 2009

(51) Int. Cl.
*H01J 35/06* (2006.01)

(52) U.S. Cl. ..... 378/136; 378/125

(58) Field of Classification Search ..... 378/125, 378/144, 136

See application file for complete search history.

(56) References Cited

U.S. PATENT DOCUMENTS

| | | | | |
|---|---|---|---|---|
| 3,942,059 | A | 3/1976 | Tran-Quang | |
| 4,132,917 | A * | 1/1979 | Bildstein et al. | 378/144 |
| 4,336,476 | A * | 6/1982 | Holland et al. | 378/125 |
| 4,651,336 | A * | 3/1987 | Le Guen et al. | 378/125 |
| 4,884,292 | A * | 11/1989 | Klostermann | 378/127 |
| 5,978,447 | A * | 11/1999 | Carlson et al. | 378/132 |
| 6,983,035 | B2 * | 1/2006 | Price et al. | 378/144 |
| 7,012,989 | B2 * | 3/2006 | Holland et al. | 378/144 |
| 2002/0085676 | A1 * | 7/2002 | Snyder | 378/130 |
| 2003/0091148 | A1 * | 5/2003 | Bittner et al. | 378/128 |
| 2004/0028184 | A1 * | 2/2004 | Hansen | 378/123 |
| 2004/0081273 | A1 | 4/2004 | Ning | |
| 2004/0171938 | A1 | 9/2004 | Grable | |
| 2005/0201520 | A1 * | 9/2005 | Smith et al. | 378/131 |
| 2006/0078084 | A1 | 4/2006 | Souchay et al. | |
| 2007/0086566 | A1 | 4/2007 | Gregerson et al. | |

FOREIGN PATENT DOCUMENTS

| | | | |
|---|---|---|---|
| DE | 3341976 | A1 * | 5/1985 |
| JP | 53097387 | A * | 8/1978 |
| JP | 03156844 | A * | 7/1991 |
| WO | 03043389 | | 5/2003 |

OTHER PUBLICATIONS

Supplemental EU Search Report dated Aug. 30, 2011 for EP Application No. 08852149.

* cited by examiner

*Primary Examiner* — Glen Kao
(74) *Attorney, Agent, or Firm* — Maschoff Gilmore & Israelsen

(57) ABSTRACT

An x-ray tube having a reduced spacing between the focal spot of an anode and an adjacent end wall of an evacuated enclosure is disclosed. This in turn positions the tube relatively closer to the chest wall of a patient during mammography procedures. In one embodiment, the x-ray tube comprises an evacuated enclosure having first and second ends interconnected by a cylindrical side wall. The evacuated enclosure includes a rotor assembly having a bearing assembly and a stem. An anode is rotatably supported by the stem of the rotor assembly and includes a target surface and an opposite second surface. The target surface is positioned to face the bearing assembly, while the second surface is positioned to face the first end of the evacuated enclosure, with no intervening structure interposed therebetween. A cathode is included to emit electrons for impingement on a focal spot of the focal track.

21 Claims, 5 Drawing Sheets

X-RAY TUBE HAVING A FOCAL SPOT PROXIMATE THE TUBE END

BACKGROUND

1. Technology Field

The present invention generally relates to x-ray tubes. In particular, embodiments of the present invention are directed to x-ray tube configurations that reduce the distance between the focal spot of an anode and an adjacent end of the evacuated enclosure in which the anode is disposed.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, and then impinged upon a material of a particular composition. This process typically takes place within an x-ray tube located in the x-ray generating device. The x-ray tube generally comprises a vacuum enclosure, a cathode, and an anode. The cathode, having a filament for emitting electrons, is disposed within the vacuum enclosure, as is the anode that is oriented to receive the electrons emitted by the cathode.

The vacuum enclosure may be composed of metal such as copper, glass, ceramic, or a combination thereof, and is typically disposed within an outer housing. Aside from a window region that allows for the passage of x-rays, the outer housing is typically covered with a shielding layer (composed of, for example, lead or similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits.

In operation, an electric current is supplied to the cathode filament, causing it to emit a stream of electrons by thermionic emission. An electric potential is established between the cathode and anode, which causes the electron stream to gain kinetic energy and accelerate toward a target surface disposed on the anode. Upon impingement at the target surface, some of the resulting kinetic energy is converted to electromagnetic radiation of very high frequency, i.e., x-rays.

The specific frequency of the x-rays produced depends at least partly on the type of material used to form the anode target surface. Target surface materials having high atomic numbers ("Z numbers") are typically employed, and are usually selected based on the application and characteristic x-ray that is desired. The resulting x-rays can be collimated so that they exit the x-ray device through predetermined regions of the vacuum enclosure and outer housing for entry into the x-ray subject, such as a medical patient.

One challenge encountered with the operation of x-ray tubes, particularly tubes employed in the field of mammography, relates to the optimum positioning of the tube with respect to the patient's body (and in particular, the portion of the patient's body that is of interest) during x-ray imaging. For example, when performing a mammography, it is beneficial to position the focal spot of the x-ray tube, i.e., the point on the anode target surface where the electrons emitted and focused by the cathode impinge, as close to the chest wall as possible. Such positioning is desirable to overcome "heel effect"—a characteristic of anode-based x-ray imaging that produces non-uniformity in the imaging x-ray beam—in order to acquire as precise an image of the breast tissue as is possible. Conversely, should the focal spot be located a relatively large distance away from the chest wall, image quality will consequently suffer.

The above notwithstanding, known tube designs are not configured to minimize spacing between the chest wall and the focal spot of the anode. In particular, known tube designs are typically configured with part or all of the cathode assembly being interposed between the anode and the nearest end wall of the vacuum enclosure. This configuration, while beneficial in some respects, nonetheless prevents placement of the focal spot desirably close to the chest wall.

The above imaging challenges present with known tube designs are exacerbated when the breast or other subject to be imaged is relatively large, thereby requiring a correspondingly large anode target surface focal track angle to be employed. Use of large focal track angles undesirably increases the size of the focal spot, and therefore is undesirable for many mammography applications.

Moreover, high voltage tubes, i.e., tubes having operating voltages greater than 50 kV, may increase chest wall-to-focal spot spacing. Specifically, as operating voltage of an x-ray tube increases, the anode-to-cathode spacing requirements necessarily also increase to provide adequate voltage standoff This increased separation of the cathode from the anode target surface correspondingly increases the distance from the focal spot on the target surface to the nearest end of the x-ray tube, and thus the chest wall of the patient, thereby producing the undesirable effects discussed above.

BRIEF SUMMARY

The present invention has been developed in response to the above and other needs in the art. Briefly summarized, embodiments of the present invention are directed to an x-ray tube having a reduced spacing between the focal spot of an anode and an adjacent end wall of an evacuated enclosure in which the anode is disposed. Among other advantages, reduced spacing allows the x-ray tube to be positioned relatively closer to the chest wall of a patient during mammography (or similar) procedures, resulting in improved tissue coverage and enhanced imaging results.

In one embodiment, an x-ray tube for mammography or other imaging applications is disclosed. The x-ray tube comprises an evacuated enclosure having first and second ends. The evacuated enclosure includes a rotor assembly that rotatably supports an anode. The anode includes a target surface and an opposite second surface. In disclosed embodiments, the target surface is oriented towards the bearing assembly, while the second surface is oriented towards the first end of the evacuated enclosure. Preferably, there is no intervening structure between the second surface of the anode and the first end of the evacuated enclosure.

A cathode assembly including a cathode head with a filament disposed therein is also included. The filament is oriented such that electrons emitted from the filament impinge on a focal spot of the anode focal track.

In a typical x-ray tube configuration, the cathode assembly is disposed between the anode and the first end of the evacuated enclosure. In contrast, embodiments of the disclosed x-ray tube are configured such that the cathode is disposed on the same side of the anode as the bearing assembly. This ensures that substantially no intervening structure exists between the second surface of the anode and the first end of the evacuated enclosure, thereby permitting the physical distance between the first end and anode focal spot to be reduced. So configured, the x-ray tube can be positioned such that the focal spot is relatively closer to the chest wall of a patient undergoing a mammography imaging procedure than what is possible in typical tube configurations. This enables better x-ray coverage and image resolution of the breast tissue regardless of breast size, and enables better imaging in the region of the chest wall.

Example embodiments of the present invention enable an anode grounded x-ray tube configuration to be utilized to further reduce the focal spot-to-enclosure end wall spacing. Additionally, the focal track angle of the anode can be reduced, thereby reducing overall focal spot size. In alternative embodiments, the thickness of the anode can also be modified to further reduce spacing to the end wall.

While disclosed embodiments could be utilized in connection with any x-ray application that would benefit from the reduced spacing between focal spot and area of interest, the techniques disclosed herein have particular utility in the field of mammography. Moreover, disclosed embodiments would be useful in connection with mammogram devices utilizing either standard analog film imagers or flat panel digital imagers. Techniques disclosed herein are also believed to provide critical advantages to newer so-called Mammo-CT (computed tomography for breast imaging) devices and applications.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-4 depict various features of embodiments of the present invention, which is generally directed to an x-ray tube configured in a manner so as to reduce the distance between an electron focal spot of the rotary anode and the nearest end of the x-ray tube. This configuration enables the x-ray tube to be placed relatively closer to the chest wall of a patient during mammography procedures, and thereby allows the central ray emitted by the tube to be substantially parallel to the chest wall. This configuration and placement results in improved mammographic imaging regardless of breast size, particularly because of the ability of disclosed embodiments to minimize imaging complications caused by the "heel effect," commonly encountered in known x-ray tube designs. Embodiments of the present invention can be included in a variety of x-ray tube designs, including high power tubes.

Though discussed herein as focusing on mammography imaging applications, embodiments of the present invention can be employed in rotary anode x-ray tubes having a variety of configurations in terms of power, size, voltage/grounding scheme, and intended use, which may not be related to mammography. In addition, in the field of mammography, disclosed embodiments would be useful in connection with mammogram systems utilizing either standard analog film imagers or flat panel digital imagers. Techniques disclosed herein are also believed to provide critical advantages to newer so-called Mammo-CT (computed tomography for breast imaging) devices and applications.

Figure 1:
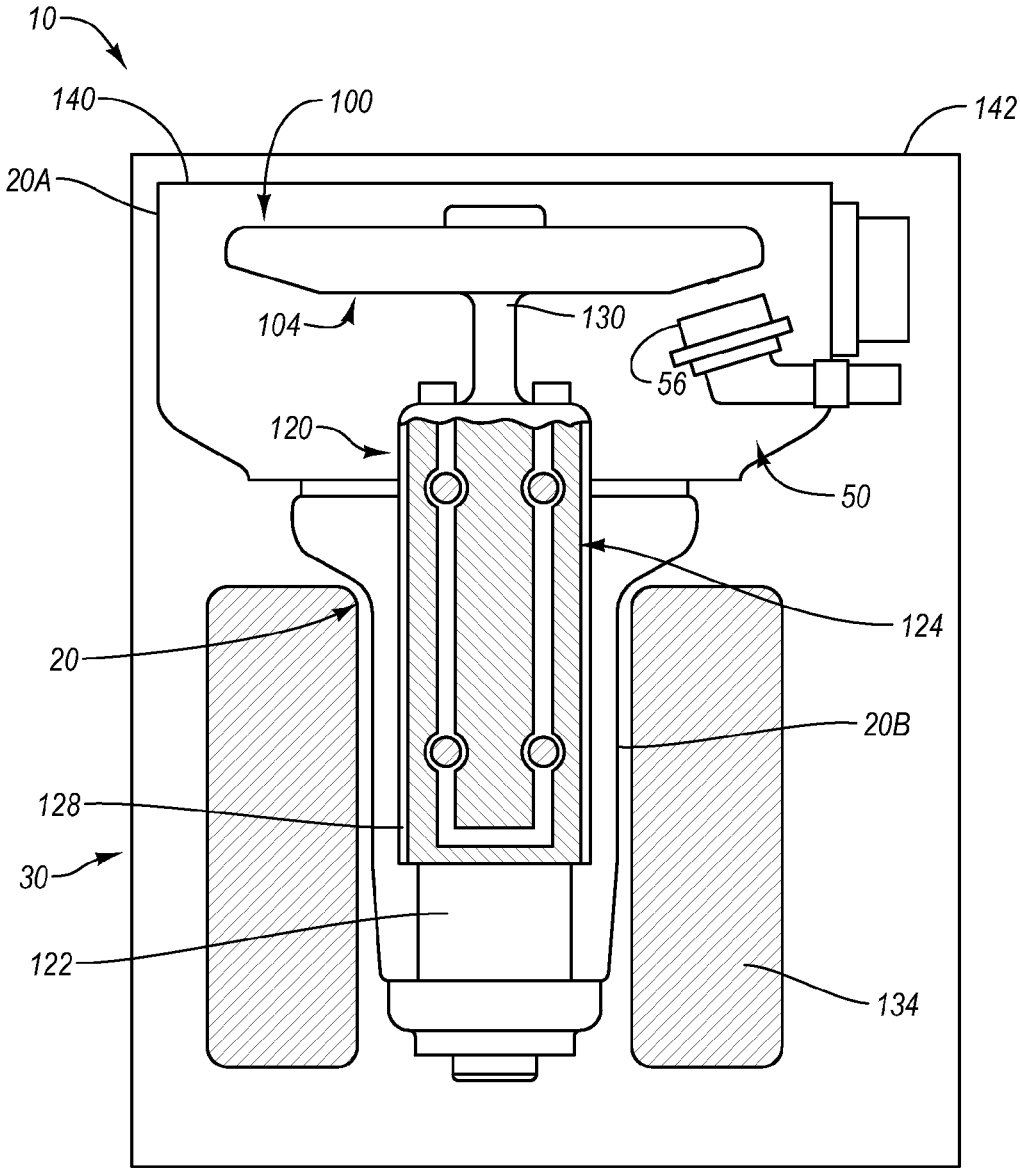
FIG. 1 is a cross sectional/partial cutaway side view of an x-ray tube configured in accordance with one example embodiment of the present invention.

Reference is first made to FIG. 1, which depicts one example embodiment of the present invention. Particularly, FIG. 1 shows an x-ray tube, designated generally at 10, which serves as one example of an x-ray generating device. The x-ray tube 10 generally includes an evacuated enclosure 20, also referred to herein as an "insert," that houses a cathode assembly 50 and an anode assembly 100. The evacuated enclosure 20 defines and provides the necessary envelope for housing the cathode and anode assemblies 50, 100 and other critical components of the tube 10 within a vacuum. In the example embodiment of FIG. 1, the evacuated enclosure 20 is further defined by a first portion 20A and second portion 20B that are hermetically sealed to one another to define the enclosure. In other embodiments, the evacuated enclosure can be defined by more than two portions, or can be integrally formed from a single piece.

The evacuated enclosure is disposed within an outer housing 30, which assists in providing shielding of unintended x-ray emission and cooling necessary for proper x-ray tube operation. Note that, in other embodiments, the outer housing is omitted and certain x-ray shielding is incorporated in the structure of the evacuated enclosure. In yet other embodiments, the x-ray shielding may be included with neither the evacuated enclosure nor the outer housing, but in another predetermined location.

As mentioned, the cathode 50 includes an emitter, such as a filament (not shown) that serves as an electron source for the production of electrons 62 (FIG. 2) during tube operation. As such, the filament is suitably connected to an electrical power source (not shown) to provide sufficient current to enable the production of the high-energy electrons 62.

Figure 2:
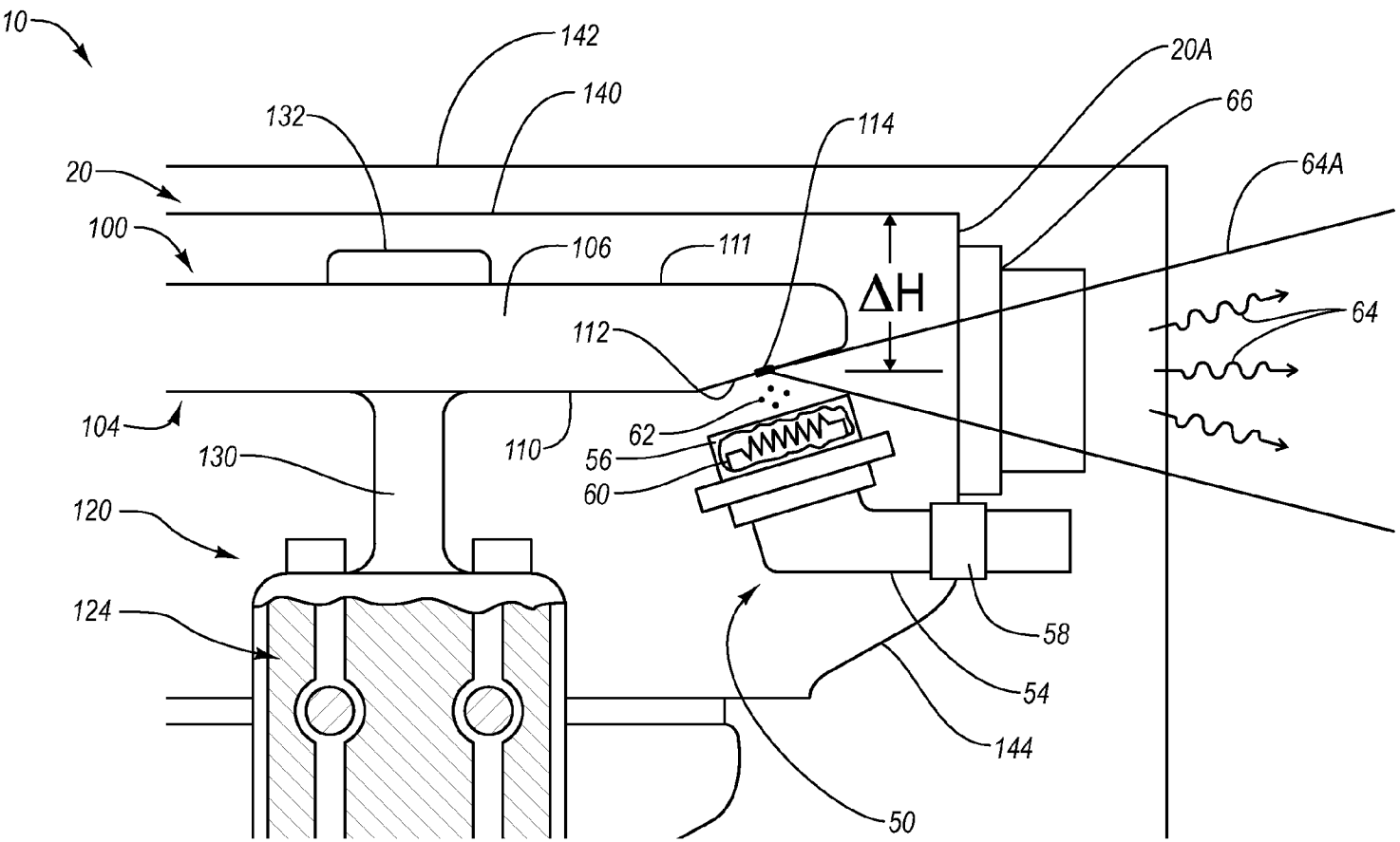
FIG. 2 is a close-up view of portions of the x-ray tube shown in FIG. 1, depicting further details thereof.

With continued reference to FIG. 1 together with FIG. 2, the anode assembly 100 is generally responsible for receiving the electrons 62 produced by the cathode 50 and converting energy resulting from the impact of the electrons into x-radiation, or x-rays 64, for emission from the tube 10. In the illustrated embodiment, the anode assembly 100 includes an anode 104 having a substrate 106 including a target surface 110 disposed thereon and an opposite second surface 111. In this particular embodiment and application, the target track surface 112 preferably comprises Molybdenum, Tungsten, Tungsten Rhenium or a similar alloy. A predetermined portion of the target surface 112 is positioned such that the stream of electrons 62 emitted by the filament of the cathode 50 impinge on the target surface so as to result in the production of the x-rays 64 for emission from the evacuated enclosure 20 via an x-ray transmissive window 66 (FIG. 2).

As the production of x-rays described herein is relatively inefficient and yields large quantities of heat, the anode assembly can be configured so as to allow the removal of heat from the anode during tube operation via, for instance, circulation of air or a cooling fluid through or past designated structures of the evacuated enclosure 20. Notwithstanding the above details, however, the structure and configuration of the anode assembly can vary from what is described herein while still residing within the claims of the present invention.

Together with FIG. 1, attention is now directed to FIG. 2, wherein further details concerning the example x-ray tube 10 are given. In greater detail, the anode 104 is supported by a rotor assembly 120, which generally includes a support post 122, a bearing assembly 124, and a rotor sleeve 128. The support post 122 is fixedly attached to a portion of the evacuated enclosure 20 such that the anode 104 is rotatably disposed about the support post via the bearing assembly 124, thereby enabling the anode to rotate with respect to the support post.

A stator 134 is circumferentially disposed about the rotor sleeve 128. As is well known, the stator 134 utilizes rotational electromagnetic fields to cause the rotor sleeve 128 to rotate. The rotor sleeve 128 is fixedly attached to the anode 104 via a rotor stem 130, thereby providing the needed rotation of the anode during tube operation. As shown in FIGS. 1 and 2, the rotor stem 130 supports the anode 104 at a predetermined level and orientation within the evacuated enclosure 20. In the illustrated embodiment, a fastener, such as a nut 132, which may be recessed, is used to secure the engagement between the rotor stem 130 and the anode 104.

As mentioned, the anode 104 includes the substrate 106 and target surface 110. A focal track 112 is included on a frustoconical portion of the anode target surface 110. A focal spot 114 is defined on the focal track 112 as the point where the electrons 62 emitted by the cathode assembly 50 impinge on the focal track. FIG. 2 shows that a distance, ΔH, is defined as the distance between the focal spot 114 and a nearest first end wall 140 of the evacuated enclosure first portion 20A.

In accordance with embodiments of the present invention, the distance ΔH in the x-ray tube 10 is desirably minimized so as to have a value that is substantially less than a corresponding distance in known x-ray tubes. To achieve this, the x-ray tube is configured in a manner exemplarily shown in FIG. 2. Particularly, the anode 104 is oriented in the evacuated enclosure first portion 20A such that the focal track 112 is directed downward, according to the orientation of the x-ray tube 10, in contrast to known anode configurations.

Commensurate with orienting the anode 104 as discussed above, the cathode assembly 50 is positioned so as to extend through a portion of a side wall 144 of the evacuated enclosure first portion 20A. This is in direct contrast to a typical configuration, wherein the cathode assembly passes through the evacuated enclosure first end wall 140. This illustrated orientation is done so as to position the cathode assembly 50 such that the electrons 62 emitted from the cathode assembly are properly oriented for impingement with the focal track 112 at the focal spot 114, as shown in FIG. 2.

In greater detail, the cathode assembly 50 is responsible for supplying a stream of the electrons 62 for producing the x-rays 64, as previously described. The cathode assembly 50 includes a support structure 54 that supports a cathode head 56. An electron emitter, such as a filament 60, is included in the cathode head 56. The cathode head 56 is positioned with respect to the anode 104 such that the electrons 62 produced by the filament 60 via thermionic emission impinge on the focal track 112 at the focal spot 114. At the same time, the cathode assembly 50 must be spaced sufficiently far from the anode 104 so as to provide sufficient voltage standoff A ceramic feedthrough 58 or other suitable isolating structure is also provided in the side wall 144 of the evacuated enclosure 20 to electrically isolate the cathode assembly 50 from the evacuated enclosure during operation of the x-ray tube 10.

Note that, in the illustrated embodiment, the cathode assembly 50 passes through the evacuated enclosure side wall 144 at a point below the window 66, from the perspective shown in FIG. 2. However, in other embodiments, the cathode assembly 50 can pass through the evacuated enclosure at other points relative to the window 66, if desired or needed for a particular application. Note also that the x-rays 64 produced by the x-ray tube 10 emanate from the focal spot 114 and through the window 66 in a conical pattern, or x-ray cone 64A.

Placement of the cathode assembly 50 in the x-ray tube 10 in the manner described above disposes the cathode assembly on the same side as the target surface 110 of the anode 104 and as the bearing assembly 124. So configured, no intervening structure is included between the anode 104 and the evacuated enclosure first end wall 140. This in turn enables the distance between the anode 104 (and focal spot 114) and the first end wall 140 to be substantially reduced over similar distances in known tube designs.

Specifically, the focal spot-to-evacuated enclosure end wall distance ΔH is desirably minimized in the illustrated tube configuration. As the end wall 142 of the outer housing is positioned adjacent the first end wall 140 as seen in FIG. 2, the distance from this wall to the focal spot is also desirably minimized. Reduction of the magnitude of ΔH enables the focal spot 114 to be positioned relatively close to the evacuated enclosure first end wall 140. This translates to improved tube positioning relative to a patient to be imaged, as explained below.

Figure 3A:
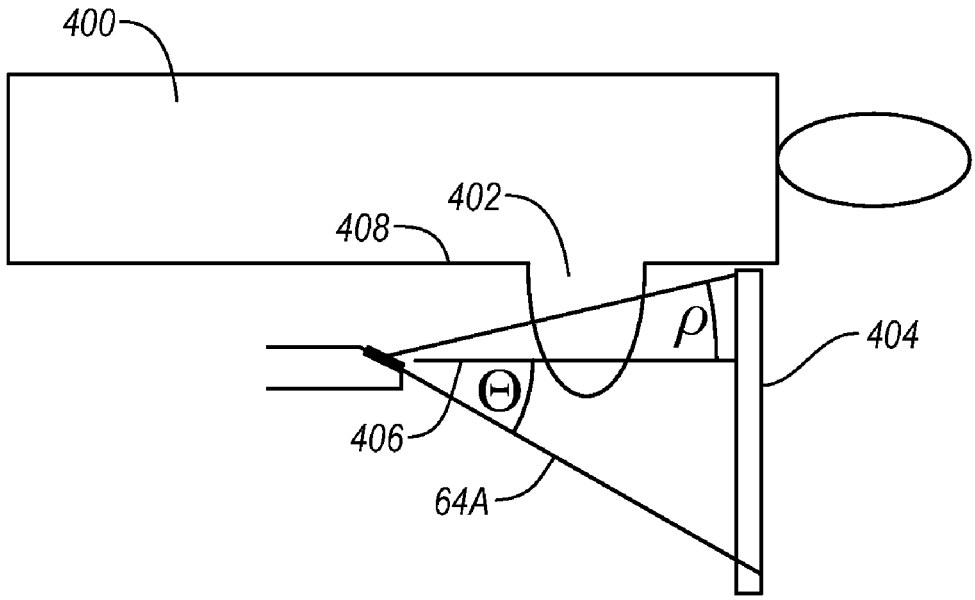
FIGS. 3A and 3B are simplified views comparing x-ray beam cone coverage for mammography imaging according to both known procedures and an example embodiment of the present invention.
Figure 3B:
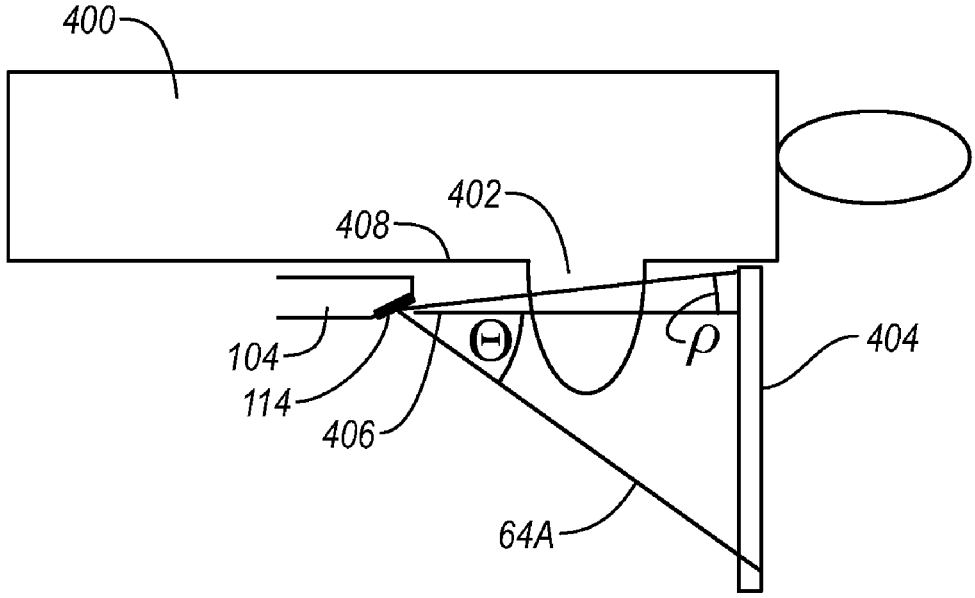

Reference is now made to FIGS. 3A and 3B, which depict in simplified view the beneficial results achieved by use of an x-ray tube configured in the manner shown in FIGS. 1 and 2. In particular, FIGS. 3A and 3B show a patient 400 having an image subject, such as a breast 402, to be imaged by an x-ray tube. For clarity, FIG. 3A shows only an anode of a standard x-ray tube, while FIG. 3B shows only the anode 104 of the x-ray tube 10 configured as those shown in FIGS. 1 and 2 having a reduced ΔH distance in the manner already discussed above. Note that, though the image subject depicted here is a breast imaged as part of a mammography procedure, other portions of the patient could alternatively be imaged.

During the mammogram procedure, x-rays are produced at the focal spot of the anode, such as the focal spot 114 of the anode 104 in FIG. 3B. The x-ray tube is positioned such that the central ray, denoted at 406, is substantially parallel to the chest wall 498 of the patient 400. The imaging film, or flat panel imager, 404 is placed at the far side of the breast. Note that in a typical configuration, the breast is compressed and the flat panel is placed immediately adjacent to the compressed breast opposite to the focal spot. The x-rays fan out in a cone-shaped pattern, depicted by the fan 64A in both figures. The detector panel 404 is positioned to capture the image produced as a result of passage of the x-rays of the x-ray cone 64A through the breast 402. Note that detector 404 can be in the form of x-ray film, or can be implemented as a flat panel imager.

A central ray 406 is defined in each x-ray cone 64A of FIGS. 3A and 3B. The portion of the x-ray cone 64A that extends from the central ray 406 toward a chest wall 408 of the patient 400 is indicated by "ρ," while the x-ray cone portion extending from the central ray away from the chest wall is indicated by "θ.: The "heel effect"—wherein the portion of the x-ray cone composed of x-rays produced from impingement of electrons at a region of the focal spot relatively closer to the outer periphery of the anode is relatively less dense than other portions of the cone—is seen in the θ portion of the x-ray cone of the standard tube shown in FIG. 3A.

In contrast, the heel effect is realized in the ρ portion of the x-ray cone 64A produced by the improved anode 104 of the present x-ray tube configuration shown in FIG. 3B. Because the anode and its corresponding focal spot 114 are positioned relatively closer to the chest wall 408 of the patient 400 as a result of the configuration of the x-ray tube in accordance with present embodiments, i.e., removal of the cathode assembly from between the anode and the evacuated enclosure first end wall, the heel effect is less problematic.

The configuration of FIG. 3B is advantageous in other respects as well. For example, as can be seen with the setup of FIG. 3A, the entire breast is not irradiated—especially at the region of the chest wall where resolution and imaging is critical. To compensate, the angle of the focal track 112 must be increased with respect to the rest of the target surface 110 (FIG. 2) and/or the x-ray tube must be tilted so that the entire breast and imager is irradiated. However, increasing the focal track 112 angle, as well as increasing the tube tilt angle, both increase the apparent focal spot length which in turn degrades image quality. In direct contrast, in the implementation of FIG. 3B, the reduction in the ΔH distance allows for a greater portion of the breast and imager to be irradiated without the need to increase the focal track angle or tube tilt. This permits the apparent focal spot length to remain smaller, thereby resulting in enhanced image quality.

Note that the reduction in ΔH is advantageous in other respects as well. For example, since the distance from the focal spot to the end of the tube is reduced, patient comfort is improved because the patient does not need the tube to be placed as close to the patient to insure proper imaging. This is particularly critical in mammography procedures where the tube is placed adjacent to the patient's head and the imager on the opposite side of the breast (i.e., the relative positions of the anode 104 and imager 404 are swapped in FIGS. 3A and 3B). Moreover, in a Mammo-CT (computed tomography for breast imaging) system, the tube and digital imager will pass under the body in the manner shown, and thus the configuration is particularly important in this application environment to insure proper imaging in the region of the chest wall.

Figure 4A:
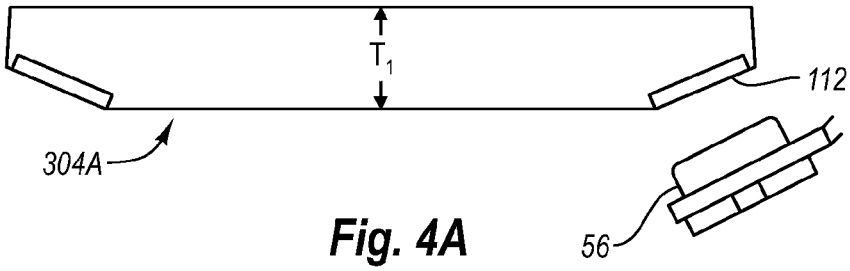
FIGS. 4A-4E are various cross sectional side views of anodes configured according to embodiments of the present invention.

Reference is now made to FIGS. 4A-4D, which depict various possible anode configurations, according to other example embodiments of the present invention. FIG. 4A shows an anode 304A having a thickness $T_1$ and configured similarly to the anode 104 shown in FIGS. 1 and 2, as discussed above. The anode 304A, as do the other anode configurations shown in FIGS. 4B-4D, includes the focal track 112 facing in a downward direction, according to the orientation shown in FIG. 4A, and the cathode head 56 of the cathode assembly positioned with respect to the focal track, as already described.

Figure 4B:
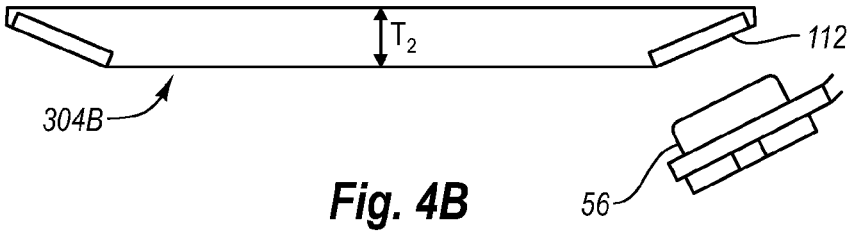

FIG. 4B depicts an anode 304B according to yet another embodiment, wherein the anode is made relatively thinner so as to have a thickness $T_2$, which is less than the thickness $T_1$ of the anode 304A shown in FIG. 4A. This in turn further reduces the distance ΔH (FIG. 2) between the focal spot and the nearest end of the evacuated enclosure.

Figure 4C:
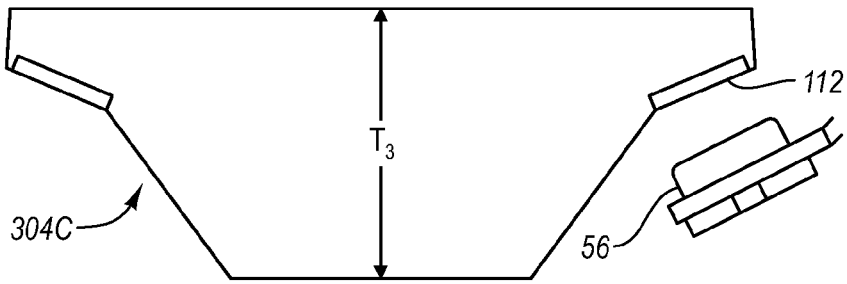

FIG. 4C shows a relatively thicker anode 304C having an increased mass for heat removal purposes during tube operation. Note that the bulk of the thickened anode 304C having a thickness $T_3$ is included at points radially interior to the inner periphery of the focal track 112 so as to preserve the relative proximity of the focal spot to the end of the evacuated enclosure.

Figure 4D:
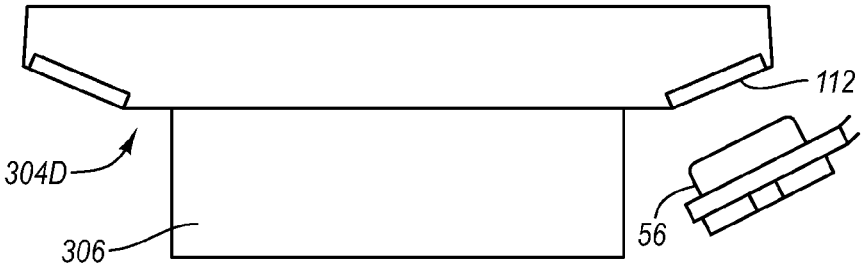

FIG. 4D shows an anode 304D having graphite (or similar material) portion 306 joined thereto to assist with heat removal from the focal track during tube operation. Again, the graphite portion 306 is positioned so as to be radially inward of the inner periphery of the focal track 112 to preserve the relative proximity of the focal spot to the end of the evacuated enclosure (see ΔH in FIG. 2). Moving the graphite to the other side of the target in this way is yet another way to reduce the distance ΔH between the focal spot and the nearest end of the evacuated enclosure.

Figure 4E:
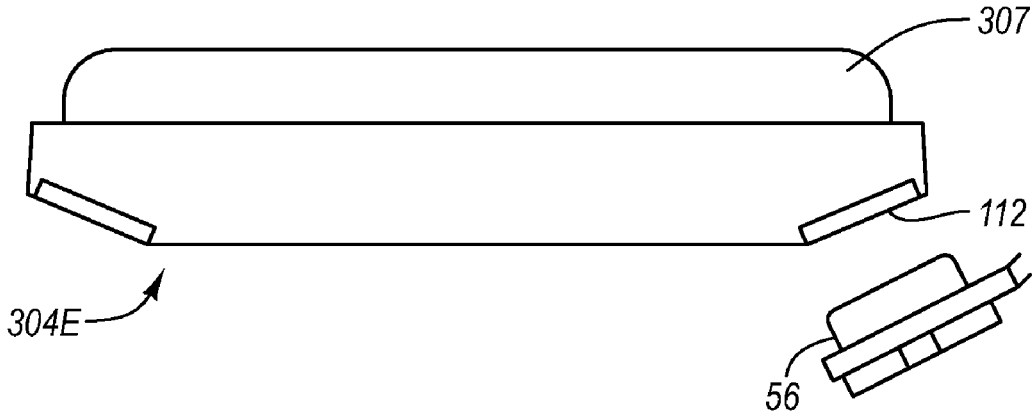

FIG. 4E shows yet another potential anode implementation 304E that might be used. In this particular embodiment, graphite portion is position the opposite side of the anode structure 304E from the cathode 56. Again, the graphite 307 (or similar material) assists with heat removal from the focal track during operation. The thickness of graphite can be minimized so as to achieve a reduced ΔH depending on the needs of a given application. The anode configurations depicted in FIGS. 4A-4E are illustrative of the various ways in which the principles of embodiments of the present invention can be incorporated into a variety of x-ray tube configurations. It will be appreciated that other configurations and approaches could also be used.

In one example embodiment, the x-ray tube 10 (FIGS. 1, 2) can include an anode-grounded configuration, wherein the anode 104 is electrically grounded and the cathode assembly 50 is held at high electric potential relative to the anode. This configuration would reduce the voltage standoff spacing requirements of the anode 104 with respect to the evacuated enclosure first end wall 140, thereby enabling further reduction of the spacing between the anode and the first end wall. Again, maintaining the cathode assembly 50 at high potential is made possible via the use of a suitable insulating structure, such as the ceramic feedthrough 58, which enables passage of portions of the cathode assembly 50 through the evacuated enclosure side wall 144.

Practice of embodiments of the present invention provide for a reduced spacing between the focal spot of an anode of an x-ray tube and an adjacent end wall of an evacuated enclosure in which the anode is disposed. This in turn enables the x-ray tube to be positioned relatively closer to an image subject, providing a number of advantages. One use where embodiments of the present invention find particular applicability is in mammography procedures, enabling the x-ray tube to be placed relatively closer to the chest wall of the patient than what is possible in known x-ray tube configurations. As a result, improved imaging of breast tissue is realized.

Further, in example embodiments an anode grounded x-ray tube configuration can be utilized to further reduce the focal spot-to-enclosure end wall spacing. Additionally, the focal track angle of the anode can be reduced, thereby desirably reducing overall focal spot size.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube suitable for use in a mammography imaging procedure, the x-ray tube comprising:

an evacuated enclosure having a first end and a second end interconnected by a side wall;

a bearing assembly;

an anode rotatably supported by the bearing assembly within the evacuated enclosure the anode having a top side and a bottom side and configured to have a predefined size, shape and electrical potential, the anode including:

a target surface disposed on the bottom side and having a radially sloped annular focal track adjacent an outer periphery of the target surface, the target surface facing and axially offset from the bearing assembly; and a second surface formed on the top side of the anode opposite from the target surface and facing the first end of the evacuated enclosure; and a cathode assembly, the cathode assembly including a support structure to retain an electron emitter that is axially aligned with a focal spot area on the focal track, wherein the electron emitter is positioned within the evacuated enclosure so as to emit electrons for impingement on the focal spot area; and an x-ray window defined in the side wall, wherein a distance H defines the distance between the focal spot area and the first end, and wherein the size, shape and electrical potential of the anode are selected so as to reduce the distance H, and substantially no intervening structure is positioned between the first end of the evacuated enclosure and the second surface of the anode so as to reduce the distance H.

2. The x-ray tube as defined in claim 1, wherein an imaginary line defined from the first end to the second end of the evacuated enclosure passes through the target surface of the anode and the emitter in succession.

3. The x-ray tube as defined in claim 1, further comprising an outer housing, the evacuated enclosure positioned within the outer housing such that the first end of the evacuated enclosure is positioned proximate a first end of the outer housing.

4. The x-ray tube as defined in claim 1, wherein the anode is grounded, thereby reducing distance H.

5. The x-ray tube as defined in claim 1, wherein electrons emitted by the cathode travel in a substantially axial direction with respect to the target surface, and x-rays emitted from the target surface travel in a substantially radial direction with respect to the target surface.

6. An x-ray tube insert, suitable for use in a mammography imaging procedure, comprising:

an evacuated enclosure having a side wall interconnecting first and second ends;

an anode having an angled focal track defined on a portion of a target surface formed on an outside surface of the anode, and a second surface opposite the target surface that is most proximate the first end of the evacuated enclosure relative to the target surface and wherein substantially no intervening structure is present between the anode and the first end of the evacuated enclosure, the anode further configured to have a predefined size, shape and electrical potential;

a cathode including a support arm extending through the side wall of the evacuated enclosure, the cathode support arm supporting a filament within the evacuated enclosure and positioned to emit electrons for impingement on a focal spot of the focal track; and an x-ray window located in the side wall at a location that is laterally offset from the side wall location of the cathode support arm, wherein a distance H defines the distance between the focal spot and the first end, and wherein the size, shape and electrical potential of the anode are selected so as to reduce the distance H.

7. The x-ray tube insert as defined in claim 6, wherein the anode is partially supported by a bearing assembly, and wherein the target surface of the anode is most proximate the bearing assembly relative to the second surface of the anode.

8. The x-ray tube insert as defined in claim 7, wherein the cathode head is disposed laterally of the bearing assembly.

9. The x-ray tube insert as defined in claim 6, wherein a minimum spacing exists between the anode and the first end of the evacuated enclosure such that x-rays produced at the focal track exit the evacuated enclosure proximate the first end.

10. The x-ray tube insert as defined in claim 6, wherein the focal track is defined on a frustoconical portion of the target surface and the anode includes a central portion having a thickness greater than that of the frustoconical portion of the anode.

11. The x-ray tube insert as defined in claim 10, wherein the central portion of the anode is at least partially composed of a graphite material.

12. The x-ray tube insert as defined in claim 6, wherein the second surface is at least partially composed of a graphite material.

13. The x-ray tube insert as defined in claim 6, wherein the target surface side of the anode is at least partially composed of a graphite material.

14. The x-ray tube insert as defined in claim 6, wherein the anode is grounded, thereby reducing distance H.

15. An x-ray tube for use in mammography procedures, comprising:

an evacuated enclosure having a first end and a second end so as to define an enclosure axis and including:

a rotor assembly including a bearing assembly and a stem, the stem being substantially parallel to the enclosure axis;

an anode rotatably supported by the stem of the rotor assembly, the anode configured to have a predefined size, shape and electrical potential and including:

a target surface including an angled focal track, the target surface positioned so as to be completely axially spaced apart from and facing the bearing assembly; and a second surface positioned so as to face the first end of the evacuated enclosure, wherein substantially no intervening structure is interposed between the second surface and the first end of the evacuated enclosure; and a cathode assembly including a cathode head having a filament disposed therein, the filament oriented such that electrons emitted from the filament are directed along a trajectory path that is substantially parallel to the axis of the evacuated enclosure and impinge upon a focal spot located on the focal track, wherein a portion of the cathode assembly passes through a generally cylindrical side wall disposed between the first end and the second end of the evacuated enclosure via an insulating structure, wherein a distance H defines the distance between the focal spot and the first end, and wherein the size, shape and electrical potential of the anode are selected so as to reduce the distance H.

16. The x-ray tube as defined in claim 15, wherein spacing between the anode second surface and the first end of the evacuated enclosure is controlled so as to reduce distance H while providing substantially sufficient voltage standoff.

17. The x-ray tube as defined in claim 15, wherein the anode is grounded and the cathode assembly is maintained at a predetermined electric potential, thereby reducing distance H.

18. The x-ray tube as defined in claim 17, wherein the angle of the focal track is selected so as to control dimensions of the focal spot.

19. The x-ray tube as defined in claim 15, wherein the first end of the evacuated enclosure is configured to be placed proximate a chest wall of a patient.

20. The x-ray tube insert as defined in claim 15, wherein the second surface is at least partially composed of a graphite material.

21. The x-ray tube insert as defined in claim 15, wherein the target surface side of the anode is at least partially composed of a graphite material.

* * * * *